US010875063B2

(12) United States Patent
Borinelli

(10) Patent No.: US 10,875,063 B2
(45) Date of Patent: Dec. 29, 2020

(54) PROCESS FOR ROLLING ALUMINIUM FOILS AND ALUMINIUM FOILS OBTAINED BY SAID PROCESS

(71) Applicant: Fabrizio Guasta, Roddi (IT)

(72) Inventor: Giovanni Borinelli, Abbadia Lariana (IT)

(73) Assignee: GUASTA, FABRIZIO, Roddi (IT)

( * ) Notice: Subject to any disclaimer, the term of this patent is extended or adjusted under 35 U.S.C. 154(b) by 179 days.

(21) Appl. No.: 16/094,805

(22) PCT Filed: Apr. 11, 2017

(86) PCT No.: PCT/IB2017/052082
§ 371 (c)(1),
(2) Date: Oct. 18, 2018

(87) PCT Pub. No.: WO2017/182911
PCT Pub. Date: Oct. 26, 2017

(65) Prior Publication Data

US 2019/0091743 A1 Mar. 28, 2019

(30) Foreign Application Priority Data

Apr. 22, 2016 (IT) ..... UA2016A2815

(51) Int. Cl.
*B21B 1/38* (2006.01)
*B21B 45/02* (2006.01)
(Continued)

(52) U.S. Cl.
CPC ..... *B21B 1/38* (2013.01); *B21B 45/0251* (2013.01); *B21B 47/04* (2013.01); *B21B 2003/001* (2013.01)

(58) Field of Classification Search
CPC ..... B21B 1/38; B21B 45/0251; B21B 47/04; B21B 2003/001; B21B 3/00; B21B 45/04
See application file for complete search history.

(56) References Cited

U.S. PATENT DOCUMENTS 4,530,230 A * 7/1985 Monks ..... B21B 1/38 29/17.4
6,202,462 B1 * 3/2001 Hansen ..... B32B 15/04 72/199

(Continued)

FOREIGN PATENT DOCUMENTS

DE 102008037619 A1 6/2010
JP H11 244910 A 9/1999

*Primary Examiner* — John C Hong
(74) *Attorney, Agent, or Firm* — Volpe Koenig

(57) ABSTRACT

Process for rolling aluminum foils includes: providing first and second laminates each having two aluminum foils overlapped one to another between which a lubricant is interposed; lubricating one face of one laminate between the first and second laminate; coupling the first laminate with the second laminate obtaining a double laminate. The lubricated face is a contact face between the first and second laminate; or it is a non-contact face between the first and second laminate, in this case being provided the intermediate steps of winding the double laminate obtaining a wound double laminate having n coils; partially separating the wound double laminate by unwinding, by one coil, both the aluminum foils of one of the first and second laminate, obtaining an at least partially wound double laminate having an end portion constituted by a respective portion of both the aluminum foils of only one of the first and second laminate.

11 Claims, 3 Drawing Sheets

(51) Int. Cl.
*B21B 47/04* (2006.01)
*B21B 3/00* (2006.01)

(56) References Cited

U.S. PATENT DOCUMENTS

2010/0242559 A1 9/2010 Saenz De Miera
2019/0015881 A1* 1/2019 Borinelli ..... B21B 1/38

* cited by examiner

PROCESS FOR ROLLING ALUMINIUM FOILS AND ALUMINIUM FOILS OBTAINED BY SAID PROCESS

FIELD OF THE INVENTION

In its more general aspect the present invention relates to a process for making aluminium foils with reduced thickness, for example but not exclusively, for use as flexible packaging, and in particular relates to an aluminium foil rolling process.

The invention further relates to aluminium foils obtained by the afore said process.

STATE OF THE ART

As it is known in packaging and conserving fields, for example of foods but also drugs, aluminium foils of reduced thickness are usually employed.

Aluminium foils of the aforementioned type, widely but improperly known also as tin foil or silver paper, are in practice foils with thickness of the order of some thousandth of millimeter, obtained by rolling aluminium foils having larger thickness.

In order to reduce the thickness of the aluminium foils to the desired value, the known art provided some processes wherein, after some steps of singly rolling in which each foil is rolled individually, a final doubly rolling step is provided wherein the two coupled foils, i.e. overlapped one to another and known simply as "laminate", are rolled together.

The coupling of two aluminium foils, also named as doubling, can be carried out substantially concurrently with the rolling, thus in the same machine named rolling mill, or it can be carried out before the rolling in a different machine named doubling machine and arranged upstream of the rolling mill.

In each case between the two aluminium foils to be coupled, before the doubly rolling, a lubricant is inserted preventing the contacting faces of the aluminium foils from remaining bound one to another, thus allowing the two coupled foils to be then separated and singularly wound in respective reels.

Although favorable, solutions as the aforesaid ones are not free from drawbacks, among which low productivity due to the need to use high number of singly rolling steps in order to obtain suitable thicknesses, and the limit itself of the obtainable thicknesses.

Moreover it is known a process wherein two coupled aluminium foils, between which a lubricant is inserted, are doubly rolled a first time, then separated to be subsequently doubly rolled a second time upon newly inserting another lubricant between them, since each rolling step entails the loss of most of the lubricant comprised between the aluminium foils.

In practice in such a process, before each doubly rolling step the insertion of lubricant between the foils to be coupled is provided, thus the prior separating or "undoubling" of the foils if already coupled and rolled together in a preceding doubly rolling step.

Such a process requires however a particularly complex rolling system and adopting complicated technical solutions, that in practice strongly limit the advantages of providing several doubly rolling steps.

The aluminium foils obtained with the processes of the known art, in particularly processes having one or more doubly rolling steps, are characterized by having a bright face and an opaque face.

The bright face of an aluminium foil obtained by a doubly rolling step comes from the direct contact of such face with the rolling mill, whereas the opaque face of the same aluminium foil is that face having been in contact, during the doubly rolling, with the other aluminium foil of the rolled laminate.

In case the aluminium foils are rolled individually, they have respectively both faces bright.

SUMMARY OF THE INVENTION

The technical problem underlying the present invention has been to provide a process for making aluminium foils with reduced thickness having characteristics such as to overcome one or more of the drawbacks mentioned above with reference to the known art.

In accordance with the present invention, the afore said problem is solved by a rolling process of aluminium foils comprising the steps of:

a) providing a first laminate comprising two aluminium foils overlapped one to another between which a lubricant is interposed;

b) providing a second laminate comprising two aluminium foils overlapped one to another between which a lubricant is interposed;

c) lubricating, at least partially, at least one face of at least one laminate between the afore said first laminate and the afore said second laminate;

d) coupling the afore said first laminate with the afore said second laminate thus obtaining a double laminate comprising four aluminium foils, wherein d') the afore said at least one lubricated face is a contact face between the afore said first laminate and the afore said second laminate, some lubricant being interposed between each aluminium foil and an adjacent aluminium foil; or else wherein d") the afore said at least one lubricated face is a non-contact face between the afore said first laminate and the afore said second laminate, the afore said double laminate having at least one outer lubricated face, in this case being provided the further intermediate steps of d'") winding, at least partially, the afore said double laminate having at least one outer lubricated face, thus obtaining an at least partially wound double laminate comprising n coils;

d"") partially separating the afore said at least partially wound double laminate by unwinding, at least by one coil, both the aluminium foils of one of the afore said first laminate and the afore said second laminate, thereby obtaining an at least partially wound double laminate comprising an end portion constituted by a respective portion of both the aluminium foils of only one of the afore said first laminate and the afore said second laminate;

d"""") unwinding the afore said at least partially wound double laminate thus obtaining a double laminate in which some lubricant is interposed between each aluminium foil and an adjacent aluminium foil;

e) rolling at least once the afore said double laminate in which some lubricant is interposed between each aluminium foil and an adjacent aluminium foil, thus reducing the thickness of the afore said double laminate;

f) separating the afore said double laminate with reduced thickness thus obtaining four aluminium foils with reduced thickness, wherein the two aluminium foils among the afore said four aluminium foils each have both faces opaque, and the other two aluminium foils among the afore said four aluminium foils each have an opaque face and a bright face.

Preferably the afore said process comprises a step g) of winding the afore said double laminate, wherein the afore said winding step g) is preceding the afore said rolling step e), thus is following the afore said coupling step d), in this case the present process comprising also a step v) of unwinding the afore said double laminate, following the afore said winding step g) and preceding the afore said rolling step e).

Preferably, the afore said process comprises a step t) of winding the afore said double laminate with reduced thickness, wherein the afore said winding step t) is following the afore said rolling step e), the afore said winding step t) being followed by a step u) of unwinding the afore said double laminate preceding the afore said step f) of separating the afore said double laminate.

Preferably, after the afore said separating step f), the present process comprises a winding step s), wherein each of the afore said four aluminium foils is wound individually.

According to the invention, the afore said coupling step d) can be preceding or substantially concurrent with the afore said step e) of rolling the afore said double laminate.

In accordance to the above and according to the invention, in the afore said process, the afore said step c) of lubricating can be preceding or substantially concurrent with the afore said step d) of coupling the afore said first laminate with the afore said second laminate.

In accordance to the above and according to an embodiment of the invention, the afore said process preferably comprises, after the afore said step d""), a step h) wherein the afore said end portion constituted by a respective portion of both the aluminium foils of only one of the afore said first laminate and the afore said second laminate, is removed, in this case the afore said step d) of coupling the afore said first laminate with the afore said second laminate being further able to precede the afore said step c) of lubricating, at least partially, at least one face of at least one laminate between the afore said first laminate and the afore said second laminate.

In regard to the afore said first laminate and the afore said second laminate, according to the invention at least one of them is preferably obtained by the steps of:

i) coupling two aluminium foils among which a lubricant is comprised;

l) in case, double-rolling the afore said two coupled aluminium foils;

m) lubricating, at least partially, at least one face of the afore said two coupled aluminium foils, the afore said at least one lubricated face being a non-contact face between the afore said two coupled aluminium foils;

n) winding, at least partially, the afore said two coupled aluminium foils that are in case double-rolled, thus obtaining a reel comprising n coils;

o) unwinding, at least by one coil, one of the afore said two aluminium foils from the afore said reel comprising n coils, thus obtaining a reel comprising an unwound end portion constituted by a respective portion of only one of the afore said two aluminium foils, the afore said reel being a laminate comprising two aluminium foils overlapped one to another between which a lubricant is interposed;

wherein preferably the afore said process further comprises, after the afore said step o), a step p) wherein the afore said end portion constituted by a respective portion of only one of the afore said two aluminium foils is removed from the afore said reel, and wherein the afore said d) of coupling the afore said first laminate with the afore said second laminate being further preceded by a step z) of unwinding the afore said two aluminium foils, thus unwinding the afore said first laminate and/or the afore said second laminate.

Moreover, it has to be mentioned that the afore described step m) can precede the afore described step n) or be substantially concurrent therewith.

Alternatively to what above, in particular in regard to the afore said first laminate and the afore said second laminate, according to another embodiment of the invention, at least one of them is preferably obtained by:

q) a respective doubling step, in case followed by:

r) a step of winding the afore said first laminate and/or the afore said second laminate.

In practice, according to the invention, a rolling process is provided in which four aluminium foils are rolled contemporaneously, which allows the productivity to be improved with respect to processes of the known art, and allows to obtain, among others, two aluminium foils with particularly reduced thickness, equal or lower than 50 μm, which have both the faces opaque.

In particular, a gloss (brightness) test carried out by a reflectometer (gloss-ethereal analysis) at 60° for a measurement along the rolling direction of both the afore said opaque surfaces of the same aluminium foil, both well recognizable to the naked eye, provided a value equal or lower and 100 gloss.

BRIEF DESCRIPTION OF THE FIGURES

Further characteristics and advantages of the invention will be more evident by the review of the following detailed description of some preferred but not exclusive embodiments shown for illustration purposes and without limitation, wherein.

DETAILED DESCRIPTION OF THE INVENTION

Figure 1:
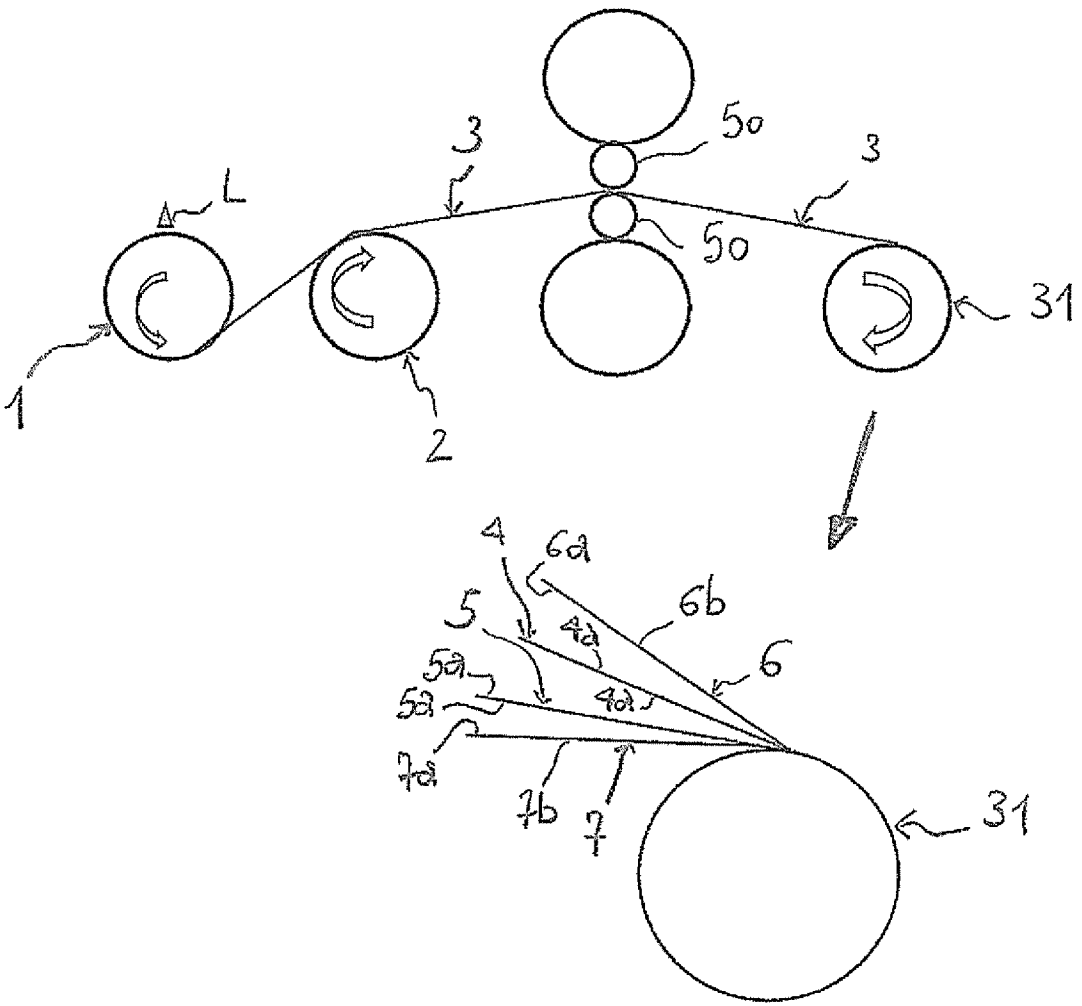
FIG. 1 schematically shows some steps of a rolling process of aluminium foils in accordance with an embodiment of the present invention, among which a doubly rolling step of a double laminate comprising a first laminate and a second laminate, each comprising two aluminium foils overlapped one to another between which a lubricant is interposed.

Referring to FIG. 1, a process for rolling aluminium foils according to a first embodiment the present invention is schematically depicted.

In detail, the present process comprises the steps of:

a) providing a first laminate, denoted as a whole with numeral 1, comprising two aluminium foils overlapped one to another between which a lubricant is interposed;

b) providing a second laminate, denoted as a whole with numeral 2, comprising two aluminium foils overlapped one to another between which a lubricant is interposed;

c) lubricating, at least partially, at least one face of at least one laminate between the first laminate 1 and the second laminate 2;

d) coupling the first laminate 1 with the second laminate 2 thus obtaining a double laminate denoted as a whole with numeral 3 and comprising four aluminium foils, wherein d') the at least one lubricated face of the first laminate 1 or second laminate 2, in which the lubricant is generically denoted with L, is a contact face between the first laminate 1 and the second laminate 2, so that some lubricant is interposed between each aluminium foil of the four aluminium foils of the double laminate 3 and an aluminium foil adjacent thereto;

e) rolling at least once the double laminate 3 in which the lubricant L is interposed between each aluminium foil and an adjacent aluminium foil, thus reducing the thickness of the double laminate 3;

f) separating the double laminate 3 with reduced thickness thus obtaining four aluminium foils with reduced thickness, wherein the two aluminium foils denoted with numerals 4 and 5 each have both faces opaque respectively denoted with numerals 4*a* and 5*a*, and the other two aluminium foils denoted with numerals 6 and 7 each have an opaque face respectively denoted with numerals 6*a* and 7*a*, and a bright or gleaming face denoted with numerals 6*b* and 7*b*.

According to the invention, the bright or gleaming faces 6*b* and 7*b* are the faces the rolling mills denoted with numeral 50 have been in contact with during the rolling of the double laminate 3, whereas the opaque faces 4*a*, 5*a*, 6*a* and 7*a* are the faces of the aluminium foils a face of an adjacent aluminium foil, during the rolling of the double laminate 3, has been in contact with, so to speak they are therefore the inner faces of the aluminium foils of the double laminate 3.

In particular, according to what above, the foils 4, 5, 6 and 7 obtained with the process according to the invention, shown a gloss of the afore said opaque surfaces lower than 100, measured with reflectometer (gloss-ethereal analysis) at 60° along the rolling direction and a thickness lower than 50 μm.

After the step f) of separating the double laminate 3 with reduced thickness, the present process preferably comprises a winding step s), wherein each of the four aluminium foils 4, 5, 6 and 7 is wound individually to form a respective coil composed of only one aluminium foil.

According to the invention, the present process can further comprise a step t) of winding the double laminate 3 with reduced thickness, then a winding step t) following the step e) of rolling the double laminate 3, to which a step u) of unwinding the same wound double laminate follows, before the step f) of separating the double laminate in single aluminium foils.

In the example of FIG. 1, after the rolling step f), the step t) of winding the double laminate 3 is shown, in which a coil denoted with numeral 31 is obtained.

Furthermore, according to the invention, the present process can further comprise a step g) of winding the double laminate 3, preceding the rolling step e), thus following the coupling step d), also the possible step g) of winding the double laminate 3 being followed by a step v) of unwinding the same double laminate, preceding the rolling step e).

Above and in the following, with the term "unwinding", therefore the "unwinding" step, the unrolling, therefore the "unrolling" step of a coil, i.e. a wound aluminium foil, a wound laminate comprising two aluminium foils, as well as a wound double laminate comprising four aluminium foils, is meant.

In regard to the step d) of coupling the first laminate 1 with the second laminate 2 thus obtaining the double laminate 3, it has to be mentioned that this step can substantially precede the step e) of rolling the double laminate, or else it can be substantially concurrent with the step e) of rolling the double laminate, this second case being that depicted in the example of FIG. 1.

Namely, in the first of two cases depicted above there is a coupling or doubling step in a suitable apparatus usually known as doubling machine, the latter being placed essentially outside the line of the real rolling process carried out in an apparatus named rolling mill, whereas in the second case the coupling or doubling step is carried out in the same apparatus in which the rolling is made, this apparatus being anyway named rolling mill.

Still according to the invention, in the present process the lubricating step c) can be preceding or substantially concurrent with the step d) of coupling the first laminate 1 with the second laminate 2.

In fact, by lubricating at least one face of the first laminate 1 or the second laminate 2, intended for the contact with a face of the other of the first laminate 1 and the second laminate 2 in making the double laminate 3, the lubricant L can be added before the coupling step d) or else also essentially concurrent with coupling step d), this second case being that depicted in the example of FIG. 1.

In detail, in regard to the first laminate 1 and the second laminate 2, according to an embodiment of the invention schematically illustrated with reference to FIG. 2, it has to be mentioned that at least one of them, and advantageously both, can be obtained through the following steps:

i) coupling two aluminium foils among which a lubricant is comprised, which are denoted on the whole with numeral 8;

l) in case, double-rolling the two coupled aluminium foils 8;

m) lubricating, at least partially, at least one face of the two coupled aluminium foils 8, wherein the at least one lubricated face is a non-contact face between the two aluminium foils 8;

n) winding, at least partially, the two coupled aluminium foils 8 that are in case double-rolled, thus obtaining a reel 9 comprising n coils;

o) unwinding, at least by one coil, one of the two aluminium foils from the reel 9 comprising n coils, thus obtaining a reel 10 comprising an unwound end portion 11 constituted by a respective portion of only one of the two aluminium foils 8, wherein the so-obtained reel is in practice a laminate, in this case a wound laminate, comprising two aluminium foils overlapped one to another between which a lubricant is interposed.

The afore illustrated steps which, as referred, can be carried out to obtain the first laminate 1 and/or the second laminate 2, thus allow one of the two outer faces of two coupled aluminium foils to be lubricated, and then obtaining two coupled foils thanks to the partial unwinding of only one of the two aluminium foils, i.e. a laminate as considered above, with the lubricant interposed between the two coupled aluminium foils, since in practice the above referred unwinding causes an inversion of the aluminium foils.

Advantageously, it is therefore possible to carry out a doubly rolling of the two coupled aluminium foils before proceeding with a subsequent rolling of the double laminate, therefore with a concurrent rolling of four aluminium foils according to the invention.

According to what above, the present process can further comprise, subsequently to the afore described step o), also a step p) in which the unwound end portion 11 constituted by a respective portion of only one of the two aluminium foils is removed from the reel 10, for example by cutting.

Figure 2:
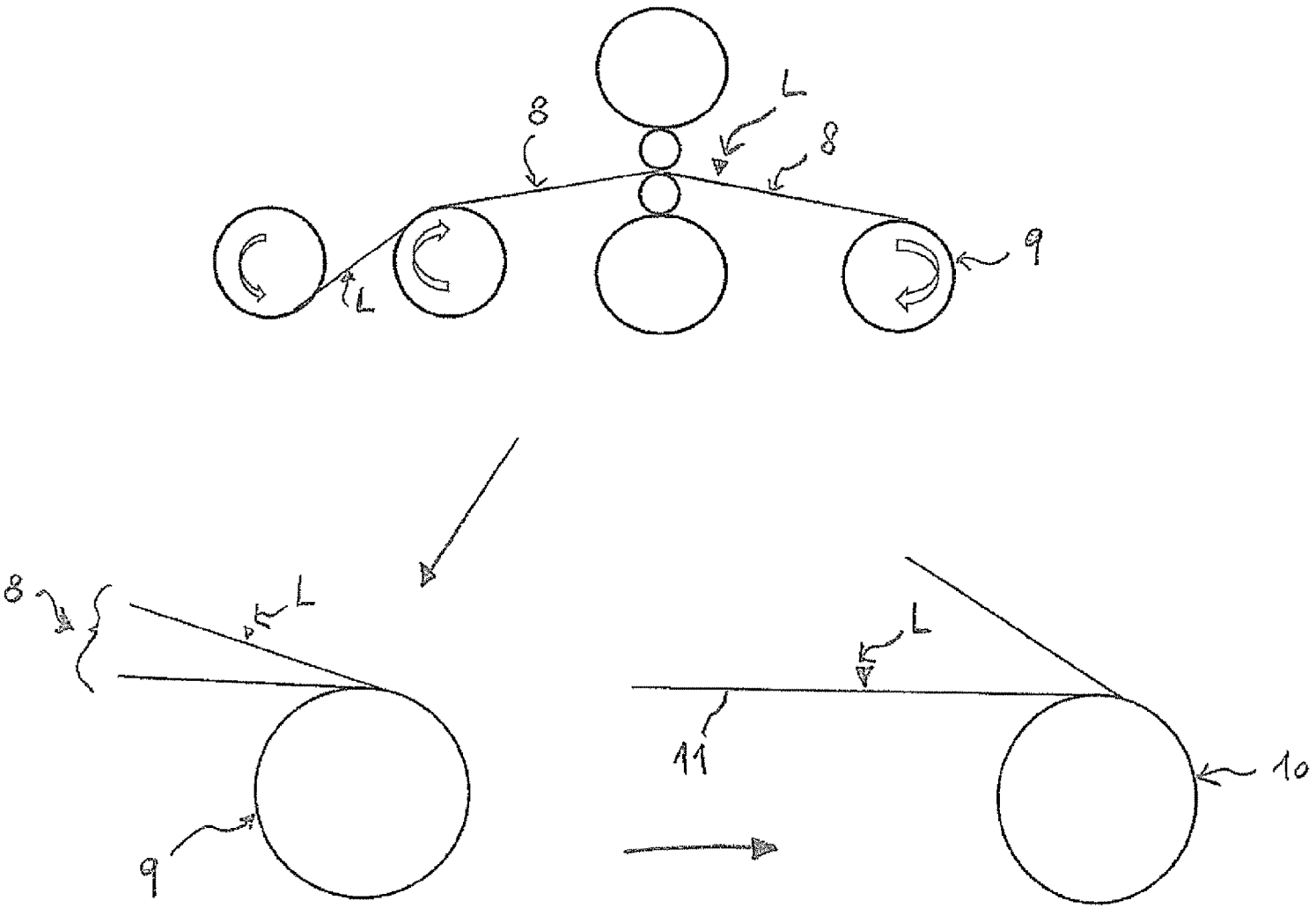
FIG. 2 schematically shows some implementing steps of the first laminate and/or the second laminate of FIG. 1, in accordance with an embodiment of the invention.

Still according to what above, the step d) of coupling the first laminate 1 with the second laminate 2 is preceded by a step z) of unwinding the two coupled aluminium foils, thus of unwinding the reel 9 or reel 10, i.e. the same first laminate 1 and/or the same second laminate 2, as they might be obtained in accordance with the example of FIG. 2.

Moreover, it has to be mentioned that the afore described step m) can precede the afore described step n) or be substantially concurrent therewith, this second case being that depicted in the example of FIG. 2.

In accordance with another embodiment of the invention, in particular in regard to the implementing of the first laminate 1 and the second laminate 2, it has to be mentioned that one of them, the other one or both can be obtained, alternatively to what depicted in the example of FIG. 2, also through:

q) a respective doubling step, in case followed by:

r) a step of winding the first laminate and/or the second laminate, wherein the winding step r) is followed by an unwinding step preceding the above described coupling step d).

In practice the doubling step q), consistently with what described above, is a step in which the two aluminium foils are coupled in a doubling machine essentially placed out of the line with respect to the real rolling process, this implementation variant not being shown in the examples of the figures.

Figure 3:
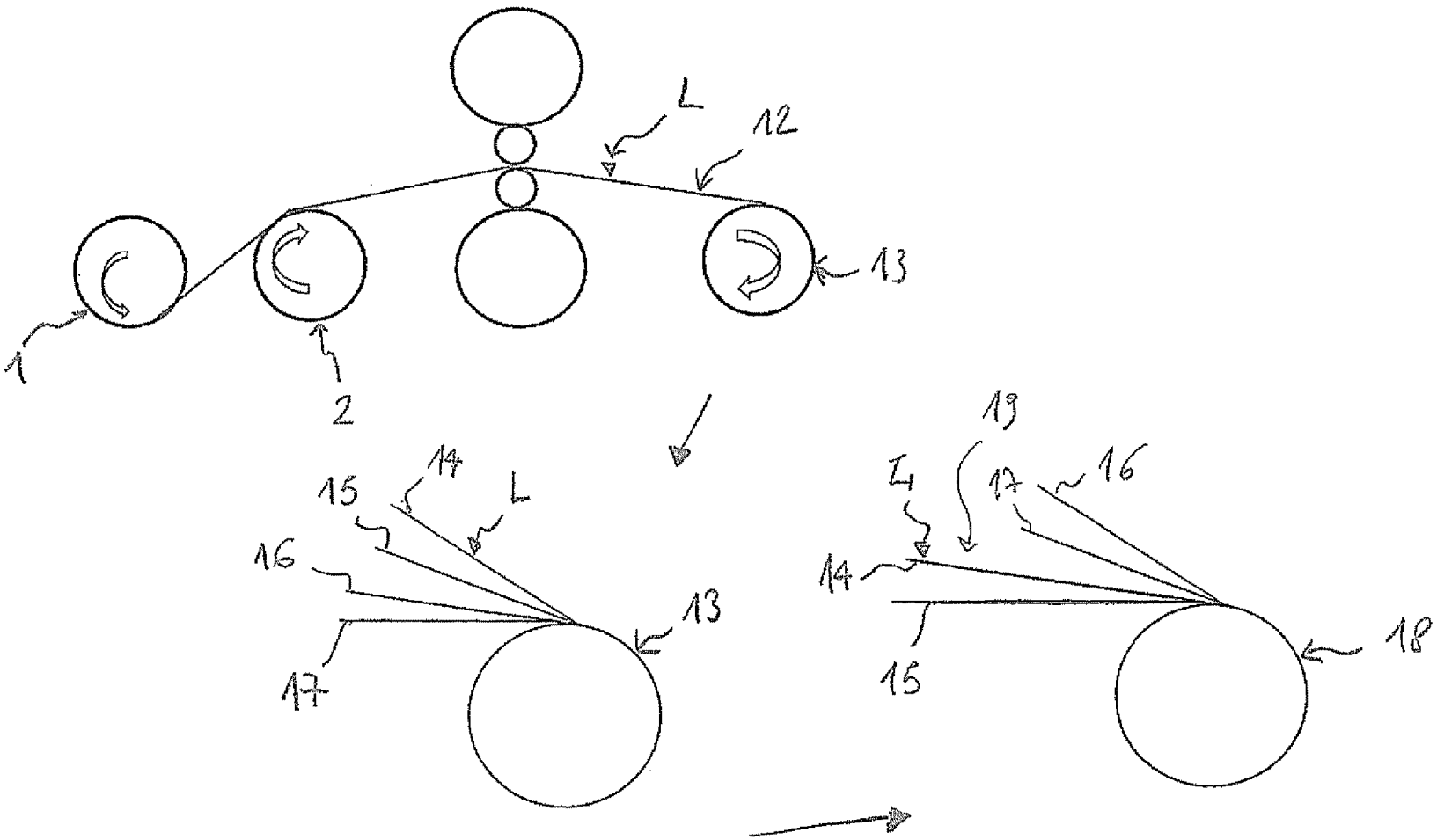
FIG. 3 schematically shows some steps of the rolling process of FIG. 1, in accordance with a further embodiment of the present invention.

Still in accordance with the invention and according to another embodiment of the present process schematically illustrated in the example of FIG. 3, a step d") alternative to the above described step d') can be provided, wherein the at least one lubricated face of at least one laminate between the first laminate 1 and the second laminate 2 is a non-contact face between the first laminate 1 and the second laminate 2.

In this way a double laminate is obtained, which has at least one outer face on which the lubricant L is spread, denoted on the whole with numeral 12.

In accordance with this implementation variant, the present process further comprises the steps of:

d'") winding at least partially the double laminate having at least one outer lubricated face, thus obtaining an at least partially wound double laminate comprising n coils and being denoted on the whole with numeral 13, and in which the four aluminium foils are denoted with numerals 14, 15, 16 and 17;

d"") partially separating the at least partially wound double laminate 13 by unwinding, at least by one coil, both the aluminium foils of one of the first laminate 1 and the second laminate 2, thereby obtaining an at least partially wound double laminate 18 comprising an end portion 19 constituted by a respective portion of both the aluminium foils of only one of the first laminate 1 and the second laminate 2;

d"""') unwinding the at least partially wound double laminate 18 thus obtaining a double laminate in which some lubricant is interposed between each aluminium foil and an adjacent aluminium foil.

In accordance with the example of FIG. 3, the aluminium foils 14 and 15 of the first laminate 1 are partially unwound by one coil, the order of the aluminium foils 14, 15, 16 and 17 in the partially wound double laminate 18 being reversed with respect to the double laminate comprising n coils and denoted with numeral 13.

In accordance with the embodiment illustrated in the example of FIG. 3, the present process can also comprise, after the step d"""'), a step h) wherein the end portion 19 constituted by a respective portion of both the aluminium foils of only one of the first laminate and the second laminate, specifically the first laminate 1, is removed, for example by cutting the same.

Still in accordance with the embodiment illustrated in the example of FIG. 3 and in addition to what reported above for the step d) of coupling the first laminate 1 and the second laminate 2, it has to be mentioned that this step can precede the step c) of lubricating, at least partially, at least one face of at least one laminate between the first laminate 1 and the second laminate 2.

Still in regard to the example of FIG. 3, it has to be mentioned that for the steps preceding the coupling step d) and subsequent to step d"") in which the double laminate is unwound (unrolled), the previously reported description is valid and is referred to.

The advantages of the present invention, already appeared evident throughout the present description, can be summarized by pointing out that a process for rolling aluminium foils is provided and has increased productivity thanks to the rolling of a double laminate, i.e. the rolling of four aluminium foils contemporaneously, possibly preceded by the doubly rolling of the two laminates forming the double laminate comprising four aluminium foils, without the need of separating the aluminium foils between a rolling step and another one to interpose between them the lubricant.

In addition to the increased productivity, the present process allows aluminium foils with particularly reduced thickness to be obtained, which have both faces opaque well recognizable to the naked eye also.

In order to meet incidental and specific requirements, several variations and modifications could be made by a field technician to the illustrated and described embodiments of present invention, provided that all are included in the scope of protection of the invention as defined by the following claims.

The invention claimed is:

1. A process for rolling aluminum foils comprising the steps of:

a) providing a first laminate (1) comprising two aluminum foils overlapped one to another between which a lubricant is interposed;

b) providing a second laminate (2) comprising two aluminum foils overlapped one to another between which a lubricant is interposed;

c) lubricating, at least partially, at least one face of at least one laminate between said first laminate (1) and said second laminate (2);

d) coupling said first laminate (1) with said second laminate (2) thus obtaining a double laminate (3, 12) comprising four aluminum foils, wherein d') said at least one lubricated face is a contact face between said first laminate (1) and said second laminate (2), some lubricant being interposed between each aluminum foil and an adjacent aluminum foil of said double laminate (3); or wherein d") said at least one lubricated face is a non-contact face between said first laminate (1) and said second laminate (2), said double laminate (12) having at least one outer lubricated face, in this case being provided the further intermediate steps of d'") winding, at least partially, said double laminate (12) having at least one outer lubricated face, thus obtaining an at least partially wound double laminate (13) comprising n coils;

d"") partially separating said at least partially wound double laminate (13) by unwinding, at least by one coil, both the aluminum foils of one of said first laminate and said second laminate, thereby obtaining an at least partially wound double laminate (18) comprising an end portion (19) constituted by a respective portion of both the aluminum foils of only one of said first laminate and said second laminate;

d'''') unwinding said at least partially wound double laminate (18) thus obtaining a double laminate in which some lubricant is interposed between each aluminum foil and an adjacent aluminum foil;

e) rolling at least once said double laminate in which some lubricant is interposed between each aluminum foil and an adjacent aluminum foil, thus reducing the thickness of said double laminate;

f) separating said double laminate with reduced thickness thus obtaining four aluminum foils with reduced thickness, wherein the two aluminum foils (4, 5; 14, 17) among said four aluminum foils each have both faces opaque, and the other two aluminum foils (6, 7; 15, 16) among said four aluminum foils each have an opaque face and a bright face.

2. The process according to claim 1, further comprising a step g) of winding said double laminate (3), said winding step g) preceding said rolling step e), said step g) of winding said double laminate being followed by a step v) of unwinding said double laminate preceding said rolling step e).

3. The process according to claim 1 further comprising, after said step d''''), a step h) wherein said end portion (19) constituted by a respective portion of both the aluminum foils of only one of said first laminate and said second laminate, is removed.

4. The process according to claim 2, wherein said step d) of coupling said first laminate and said second laminate is preceding said step c) of lubricating, at least partially, at least one face of said at least one laminate of said first laminate and said second laminate.

5. The process according to claim 1, wherein at least one of said first laminate and said second laminate is obtained by the steps of:

i) coupling two aluminum foils among which a lubricant is comprised;

l) in case, double-rolling said two coupled aluminum foils (8);

m) lubricating, at least partially, at least one face of said two coupled aluminum foils (8), said at least one lubricated face being a non-contact face between said two coupled aluminum foils (8);

n) winding, at least partially, said two coupled aluminum foils (8) that are in case double-rolled, thus obtaining a reel comprising n coils (9);

o) unwinding, at least by one coil, one of said two aluminum foils from said reel comprising n coils (9), thus obtaining a reel (10) comprising an unwound end portion (11) constituted by a respective portion of only one of said two aluminum foils, said reel (10) being a laminate comprising two aluminum foils overlapped one to another between which a lubricant is interposed.

6. The process according to claim 5 further comprising, after said step o), a step p) wherein said end portion (11) constituted by a respective portion of only one of said two aluminum foils is removed from said reel.

7. The process according to claim 1, wherein said first laminate and/or said second laminate are obtained from:

q) a respective doubling step, in case followed by:

r) a step of winding said first laminate and/or said second laminate.

8. The process according to claim 1, wherein said lubricating step c) is preceding or substantially concurrent with said step d) of coupling said first laminate with said second laminate.

9. The process according to claim 1 wherein said coupling step d) is preceding or substantially concurrent with said step e) of rolling said double laminate.

10. The process according to claim 1, comprising, after said separating step f), a winding step s), wherein each of said four aluminum foils is wound individually.

11. The process according to claim 1, further comprising a step t) of winding said double laminate with reduced thickness, said winding step t) following said rolling step e), said winding step t) being followed by a step u) of unwinding said double laminate preceding said step f) of separating said double laminate.

* * * * *